United States Patent [19]

Bennett et al.

[11] Patent Number: 5,029,295

[45] Date of Patent: Jul. 2, 1991

[54] BANDGAP VOLTAGE REFERENCE USING A POWER SUPPLY INDEPENDENT CURRENT SOURCE

[75] Inventors: Paul T. Bennett, Phoenix; Robert B. Davies; David F. Mietus, both of Tempe, all of Ariz.

[73] Assignee: Motorola, Inc., Schaumburg, Ill.

[21] Appl. No.: 546,636

[22] Filed: Jul. 2, 1990

[51] Int. Cl.[5] ..... G05F 3/30

[52] U.S. Cl. ..... 323/313; 323/316

[58] Field of Search ..... 323/313, 314, 315, 316, 323/901, 907; 307/296.1, 296.6, 310

[56] References Cited

U.S. PATENT DOCUMENTS

| | | | |
|---|---|---|---|
| 4,435,678 | 3/1984 | Joseph et al. | 323/315 |
| 4,441,070 | 4/1984 | Davis et al. | 323/268 |
| 4,628,248 | 12/1986 | Birritella et al. | 323/314 |
| 4,673,867 | 6/1987 | Davis | 323/315 |
| 4,683,416 | 7/1987 | Bynum | 323/314 |
| 4,786,856 | 11/1988 | Metcalf et al. | 323/315 |
| 4,808,908 | 2/1989 | Lewis et al. | 323/313 |
| 4,956,567 | 9/1990 | Hunley et al. | 323/907 |

OTHER PUBLICATIONS

A. Paul Brokaw, "A Simple Three-Terminal IC Bandgap Reference", IEEE Journal of Solid-State Circuits, vol. SC-9, No. 6, Dec. 1974, pp. 388-393.

*Primary Examiner*—Peter S. Wong
*Attorney, Agent, or Firm*—Robert D. Atkins

[57] ABSTRACT

A voltage reference circuit is provided for developing an output voltage operating independent of temperature and power supply variation. A current reference circit provides a current reference signal operating independent of power supply variation and having a predetermined temperature coefficient and flowing through a first transistor and a first resistor each having opposite temperature coefficients. The output voltage is established as the sum of the base-emitter junction potential of the first transistor and the potential developed across the first resistor. The temperature coefficient of the potential developed across the first resistor substantially cancels the temperature coefficient across the base-emitter junction of the first transistor thereby providing the output voltage operating independent of temperature and power supply variation.

17 Claims, 1 Drawing Sheet

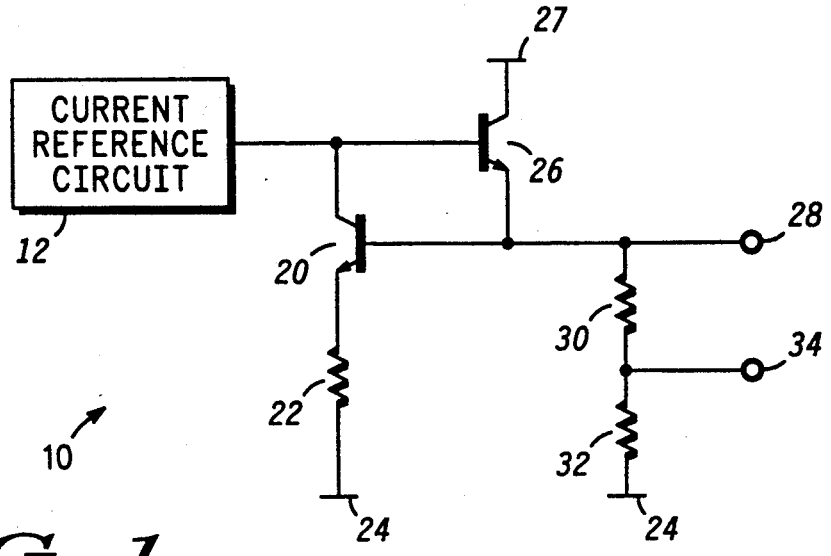
FIG. 1
FIG. 2
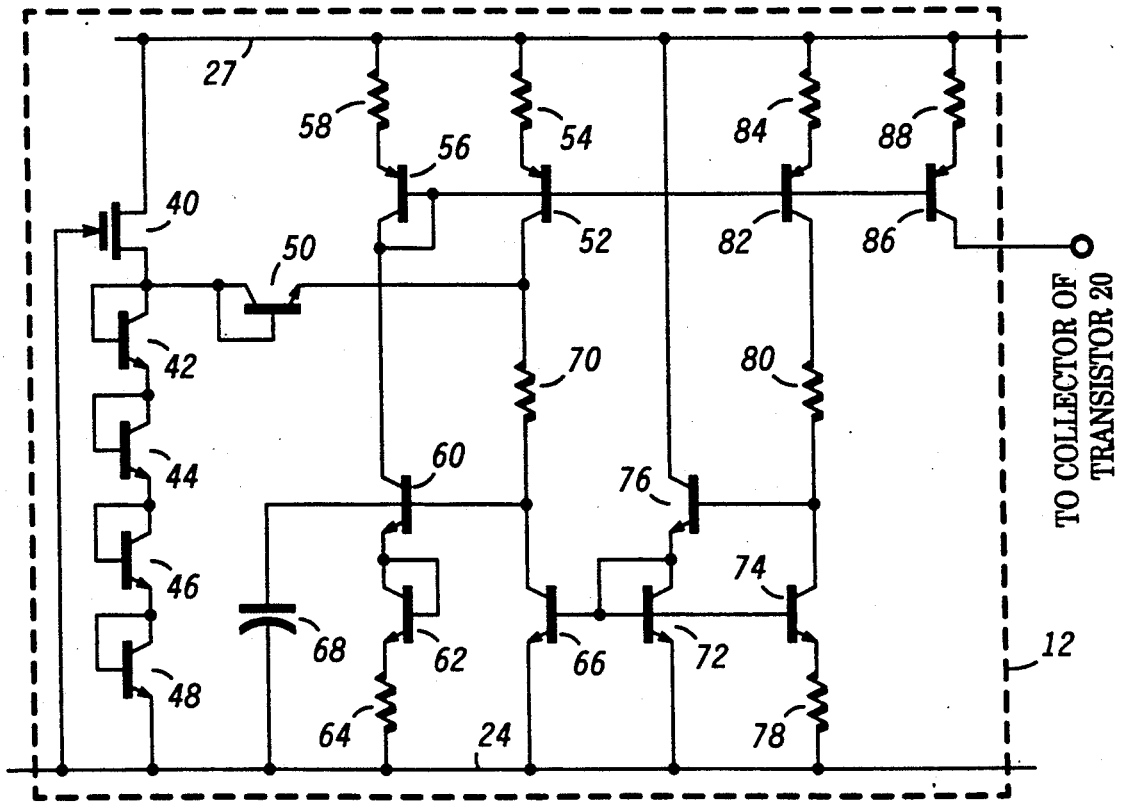

BANDGAP VOLTAGE REFERENCE USING A POWER SUPPLY INDEPENDENT CURRENT SOURCE

BACKGROUND OF THE INVENTION

This invention relates to voltage reference circuits, and more particularly, to a bandgap voltage reference circuit for providing a stable output voltage operating independent of temperature and power supply variations.

Voltage reference circuits are common in many modern electronic designs for providing a stable reference signal. The bandgap voltage reference circuit is well suited for this niche due to its temperature independent characteristics as discussed in an article entitled "A SIMPLE THREE-TERMINAL IC BANDGAP REFERENCE" by A. Paul Brokaw, IEEE Journal of Solid State Circuits, Vol. SC-9, No. 6, December, 1974. Briefly, the Brokaw article discloses a two transistor configuration conducting equal currents, but having dissimilar emitter areas, say eight-to-one, creating different current densities and base-emitter junction potentials ($V_{be}$). The first transistor typically possesses the larger emitter area and, correspondingly, the lower current density and the lesser $V_{be}$. By connecting two resistors in series with the emitter path of the first transistor and coupling the emitter of the second transistor to the interconnection thereof, a delta $V_{be}$ having a positive temperature coefficient is developed across the upper resistor. If the currents flowing through the first and second transistors are made of appropriate and constant magnitude and equal in value, the positive temperature coefficient of the voltage across the upper resistor tends to cancel the inherent negative temperature coefficient of the base-emitter junction of the first transistor thereby providing an output voltage at the collector of the second transistor which is insensitive to temperature variation, as is understood.

The current flowing through the first and second transistors is typically provided by a PNP transistor current mirror configuration having the emitters thereof coupled to the positive power supply conductor. Any transients appearing on the positive power supply are reflected in the current flowing through the first and second transistors, inducing variation in the $V_{be}$'s thereof and the potential developed across the emitter resistors. This translates to movement in the collector potential of the second transistor, thus, the output voltage is dependent upon the power supply voltage. The fluctuation in the circuit signal levels attributed to power supply variation is commonly known as the Early voltage effect and is an undesirable condition which adversely influences the regulated output signal.

Hence, there is a need for an improved voltage reference circuit having an output voltage operating independent of temperature and power supply variations.

SUMMARY OF THE INVENTION

Accordingly, an objective of the present invention is to provide an improved voltage reference circuit.

Another object of the present invention is to provide an improved voltage reference circuit having an output voltage operating independent of temperature.

Yet another object of the present invention is to provide an improved voltage reference circuit having an output voltage operating independent of the power supply.

Still yet another object of the present invention is to provide an improved voltage reference circuit having a controllable temperature coefficient.

In accordance with the above and other objectives there is provided an improved voltage reference circuit for providing an output voltage comprising a first circuit including an output for supplying a current having a predetermined temperature coefficient. A first transistor is also provided having a collector coupled to the output of the first circuit, a base coupled to the output of the voltage reference circuit and an emitter coupled through a first resistor to a first source of operating potential for conducting the current having a predetermined temperature coefficient which develops a potential across the first resistor having a temperature coefficient opposing the temperature coefficient across the base-emitter junction of the first transistor. A second circuit is coupled between the collector and base of the first transistor for supplying base drive thereto.

In another aspect, the present invention comprises a method of developing an output voltage operating independent of temperature. A first current is supplied having a predetermined temperature coefficient and passed through a first resistor and a first transistor having a temperature coefficient across the base-emitter junction thereof. The potential developed across the first resistor has a temperature coefficient opposing the temperature coefficient across the base-emitter junction of the first transistor for substantially canceling temperature induced variation in the output voltage.

BRIEF DESCRIPTION OF THE DRAWINGS

FIG. 1 is a schematic and block diagram illustrating the preferred embodiment of the present invention; and FIG. 2 is a schematic diagram illustrating further detail of the current reference circuit.

DETAILED DESCRIPTION OF THE PREFERRED EMBODIMENT

Referring to FIG. 1, voltage reference circuit 10 is shown comprising current reference circuit 12 having an output for providing a current reference signal flowing into the collector of transistor 20. The emitter of transistor 20 is coupled through resistor 22 to power supply conductor 24, operating at ground potential. The collector and base of transistor 20 are coupled to the base and emitter of transistor 26, respectively, while the collector of transistor 26 is coupled to power supply conductor 27, typically operating at a positive potential such as $V_{CC}$. An output voltage operating independent of temperature and power supply variation is provided at output terminal 28 that is the base of transistor 20. In addition, resistors 30 and 32 are serially coupled between output terminal 28 and power supply conductor 24 for providing a divider ratio of the output voltage at output 34.

Further detail of current reference circuit 12 is shown in FIG. 2 including FET transistor 40 operating as a resistor and having a source coupled to power supply conductor 27, a gate coupled to power supply conductor 24 and a drain coupled to the base and collector of diode configured transistor 42. The emitter of transistor 42 is coupled to the collector and base of transistor 44, while the emitter of transistor 44 is coupled to the base and collector of transistor 46. The emitter of transistor 46 is coupled to the base and collector of transistor 48, and the emitter of the latter is coupled to power supply conductor 24 thereby forming a diode stack for developing a voltage of four base-emitter junction potentials ($4V_{be}$'s) at the collector and base of transistor 50. The emitter of transistor 50 is coupled to the collector of transistor 52, and the emitter of transistor 52 is coupled through resistor 54 to power supply conductor 27, while the emitter of transistor 56 is coupled through resistor 58 to power supply conductor 27, and the base and collector of transistor 56 are coupled together to the collector of transistor 60. The emitter of transistor 60 is coupled through diode configured transistor 62 and resistor 64 to power supply conductor 24, and the base of transistor 60 is coupled to the collector of transistor 66, through capacitor 68 to power supply conductor 24 and through resistor 70 to the collector of transistor 52. The base of transistor 66 is coupled to the base and collector of transistor 72, to the base of transistor 74 and to the emitter of transistor 76. The emitters of transistors 66, 72 and 74 are coupled to power supply conductor 24, the latter path including resistor 78. The collector and base of transistor 76 are coupled to power supply conductor 27 and to the collector of transistor 74, respectively, and the collector of transistor 74 is also coupled through resistor 80 to the collector of transistor 82, which includes an emitter coupled through resistor 84 to power supply conductor 27 and a base coupled to the bases of transistors 52 and 56 for developing a reference potential. The base of transistor 82 is also coupled to the base of transistor 86 which includes an emitter coupled through resistor 88 to power supply conductor 27 and a collector that is the output of current reference circuit 12 for providing the current reference signal.

The discussion of voltage reference circuit 10 begins with the operation of current reference circuit 12 as a positive potential, $V_{CC}$, is applied at power supply conductor 27. FET transistor 40 is selected for providing approximately 100K ohms of resistance between power supply conductor 27 and the top of the diode stack formed of transistors 42–48 for limiting the current flowing therethrough. The potential applied at the collector of transistor 52 is thus $3V_{be}$'s above ground potential ($4V_{be}$'s less the $V_{be}$ of transistor 50) which is sufficient to conduct current through resistor 70 and turn on transistors 60 and 62. The current flowing through transistor 60 reduces the voltage at the base and collector of transistor 56 turning the latter on and completing a first conduction path between power supply conductors 27 and 24 through resistor 58, transistors 56, 60 and 62 and resistor 64. The low potential at the base of transistor 56 also truns on transistors 52 and 82 creating a second conduction path through resistor 54, transistor 52, resistor 70 and transistor 66, and a third conduction path through resistor 84, transistor 82, resistor 80, transistor 74 and resistor 78. Once current reference circuit 12 is started, the voltage developed at the collector of transistor 52 reverse biases the base-emitter junction of transistor 50 thereby removing transistors 40–50 from consideration.

The current flowing through the collector-emitter conduction path of transistor 76 supplies the base drive for transistors 66, 72 and 74. This diverts negligible current from the collector of transistor 74 as the base current is effectively divided by the forward current gain of transistor 76. Transistor 72 helps maintain a stable $V_{be}$ across the base-emitter junction of transistor 66 as very little current flows through the collector-emitter conduction path thereof. Resistors 54, 58 and 84 are matched (e.g., 2K ohms) for establishing identical $V_{be}$'s for transistors 52, 56 and 82 and equal currents, say 50 microamps, flowing through the first, second and third conduction paths defined above. Resistors 70 and 80 are also matched (e.g., 28K ohms) as are resistors 64 and 78 (e.g., 720 ohms) for providing equal potentials at the collectors of transistors 52 and 82 and equal potentials at the collectors of transistors 66 and 74, respectively. That is, the collector voltage of transistor 74 is the $V_{be}$ of transistor 76 plus the $V_{be}$ of transistor 74 plus the current flowing through the third conduction path times the value of resistor 78, while the collector voltage of transistor 66 is the $V_{be}$ of transistor 60 plus the $V_{be}$ of transistor 62 plus the potential developed across resistor 64. It is important to note that the emitter areas of transistors 62 and 74 are sized larger than the emitter areas of transistors 60 and 76 and therefore conduct a fraction of the current density. For example, transistors 62 and 74 may be selected with four times the emitter area of transistors 60 and 76 and correspondingly conduct one-fourth the current density. Thus, with the $V_{be}$'s of transistors 60 and 62 equal, the $V_{be}$'s of transistor 62 and 74 equal and the potentials developed across resistors 64 and 78 equal, the collectors of transistors 66 and 74 are also equal.

The feedback loop formed of transistors 56, 60 and 62 provides the immunity from power supply variations. If the voltage applied at power supply conductor 27 falls, the potential at the emitters of transistors 52, 56 and 82 also drops thereby decreasing the $V_{be}$'s thereof and the current flow through the second and third conduction paths. The collector voltage of transistors 66 and 74 tends to rise as less potential is developed across resistors 70 and 80 thereby increasing the $V_{be}$ of transistor 60, drawing more collector current and reducing the voltage developed at the collector of transistor 56 which compensates the $V_{be}$'s of transistors 52, 56 and 82 re-establishing the nominal current flow through the second and third conduction paths. Alternately, if the voltage applied at power supply conductor 27 rises, the potential at the emitters of transistors 52, 56 and 82 increases the $V_{be}$'s thereof and the current flow through the second and third conduction paths. The collector voltage of transistors 66 and 74 falls as more potential is developed across resistors 70 and 80, decreasing the $V_{be}$ of transistor 60 which draws less collector current and increases the collector voltage of transistor 56 and compensating the $V_{be}$'s of transistors 52, 56 and 82 again re-establishing the nominal current flow through the second and third conduction paths. Capacitor 68 is provided for decoupling the high frequency components at the base of transistor 60 slowing and stabilizing the response of the feedback loop. Hence, the potential developed at the bases of transistors 52, 56 and 82 is substantially independent of variation in power supply conductor 27 so as to eliminate the Early voltage effect. Moreover, the base currents of transistors 60 and 76 are equal, and the collector voltage of transistors 52 and 82 are equal and constant regardless of the supply voltage.

The reference signal developed at the base of transistors 52, 56 and 82 is determined by the $V_{be}$ of transistor 82 and the current flowing through the third conduction path ($I_C$) times the value of resistor 84. Since transistors 66 and 74 operate at different current densities, their $V_{be}$'s are dissimilar and a delta $V_{be}$ is developed across resistor 78 having a positive temperature coefficient. Thus, the current $I_C$ flowing through resistor 78 may be calculated as follows:

$$V_{66} = V_{74} + I_C \times \tag{1}$$

$$R_{78}\frac{kT}{q}\ln\left(\frac{I_{C66}}{I_{S66}}\right) = \frac{kT}{q}\ln\left(\frac{I_{C74}}{I_{S74}}\right) + I_C \times R_{78}$$

where:

$V_{66} = V_{be}$ of transistor 66
$V_{74} = V_{be}$ of transistor 74
$R_{78}$ = value of resistor 78
k = Boltzman's constant
T = absolute temperature
q = the electron charge
$I_{C66}$ = collector current through transistor 66
$I_{S66}$ = saturation current through transistor 66
$I_{C74}$ = collector current through transistor 74
$I_{S74}$ = saturation current through transistor 74

As stated, the emitter area of transistor 74 is four times (4A) the emitter area of transistor 66 (1A). By combining terms and dividing out the collector current and saturation current ratios, equation (1) may be reduced to:

$$I_C \times R_{78} = \frac{kT}{q}\ln\left[\left(\frac{I_{C66}}{I_{C74}}\right)\left(\frac{I_{S74}}{I_{S66}}\right)\right] \tag{2}$$

$$I_C = \frac{\frac{kT}{q}\ln(4)}{R_{78}}$$

The current $I_C$ is determined by resistor 78 from equation (2); however, observe that the current flowing through the first, second and third conduction paths and correspondingly the reference signal provided at the bases of transistors 52, 56 and 82 is still of function of temperature. This temperature dependency may be used advantageously as will be shown.

Returning to FIG. 1, the value of resistor 88 is matched with resistors 54, 58 and 84 for providing a current reference signal flowing through transistor 86 and transistor 20 and resistor 22 equal to that of the third conduction path, current $I_C$, and having a similar temperature coefficient and operating independent of the power supply. The base current for transistor 20 is supplied through the collector-emitter conduction path of transistor 26 thereby diverting negligible current from the collector of transistor 20 due to its forward current gain. The temperature and power supply regulated output voltage provided at output terminal 28 is thus equal to the $V_{be}$ of transistor 20 plus the value of resistor 22, say 10K ohms, times the current $I_C$, or approximately 1.18 volts. Resistors 30 and 32 form a conventional voltage divider circuit for providing a reduced output voltage at output 34. Furthermore, the output voltage is independent of power supply because the current refernce signal provided by the current reference circuit 12 as shown is also independent of power supply variation.

For the temperature compensation feature, the goal is balance the negative temperature coefficient of the $V_{be}$ of transistor 20, approximately −1.68 mV/°K., against the positive temperature coefficient of the potential developed across resistor 22. The positive temperature coefficient as seen in equation (2) in combination with resistor 22, which is fabricated from the same base material (125 ohms/square) of similar geometries as resistor 78 and therefore matched with a temperature coefficient of about 688 ppm/°K., substantially cancels the negative temperature coefficient of transistor 20 thereby providing an output voltage independent of temperature. The cancellation of the temperature coefficients between the potential across resistor 22 and the $V_{be}$ of transistor 20 is further demonstrated as follows. The output voltage provided at output terminal 28 is given as:

$$V_{28} = V_{20} + I_C \times R_{22} \tag{3}$$

Taking the derivative with respect to temperature yields:

$$\frac{\partial V_{28}}{\partial T} = \frac{\partial I_C}{\partial T} \times R_{22} + I_C \times \frac{\partial R_{22}}{\partial T} + \frac{\partial V_{20}}{\partial T} \tag{4}$$

Substituting equation (2) into equation (4) produces:

$$\frac{\partial V_{28}}{\partial T} = \left[\frac{R_{78}\frac{k}{q}\ln(4) - \frac{kT}{q}\ln(4)\frac{\partial R_{78}}{\partial T}}{(R_{78})^2}\right]R_{22} + \frac{\frac{kT}{q}\ln(4)}{R_{78}}\left(\frac{\partial R_{22}}{\partial T}\right) + \frac{\partial V_{20}}{\partial T} \tag{5}$$

Since resistors 22 and 78 are fabricated from the same base material and have similar geometries, it can be shown that:

$$\frac{\partial R_{78}}{\partial T} = \frac{\partial R_{22}}{\partial T} = 668 \times 10^{-6}\ \text{ohms/°}K.$$

Furthermore, a typical value for the temperature coefficient of the $V_{be}$ of transistor 20 is −1.68 mV/°K. By selecting $I_C$ at 50 microamps, resistor 22 at 10K ohms and resistor 78 at 720 ohms with a nominal temperature of 300° K., equation (5) reduces to:

$$\frac{\partial V_{28}}{\partial T} = 1.66 + 33.4 \times 10^{-9} + (-1.68) \approx 0\ \text{mV/°}K.$$

Notably, the temperature coefficient of the output voltage can be made non-zero and easily controlled with a positive or negative slope by adjusting the values of resistors 78 and 22. For example, by increasing the value of resistor 22, the output voltage at output terminal 28 will have a positive slope temperature coefficient. Conversely, the temperature coefficient of the output voltage may have a negative slope by decreasing the value of resistor 22.

Hence, what has been described is a novel voltage reference circuit using a current reference signal flowing through a first transistor and a first resistor, operating independent of the power supply and having predetermined temperature coefficient for developing a potential across the first resistor with a positive temperature coefficient which substantially cancels the negative temperature coefficient of the $V_{be}$ of the first transistor for providing an output voltage operating independent of temperature and power supply variation.

We claim:

1. A voltage reference circuit for providing a voltage at an output, comprising:

first means including an output for supplying a current having a selectable temperature coefficient;

a first transistor having a collector, a base and an emitter, said collector being coupled for receiving said current having said selectable temperature coefficient from said output of said first means, said base being coupled to the output of the voltage reference circuit, said first transistor having a temperature coefficient across the base-emitter junction thereof;

second means coupled between said collector and base of said first transistor for supplying base drive thereto; and a first resistor coupled between said emitter of said first transistor and a first source of operating potential for conducting said current having said selectable temperature coefficient which develops a potential across said first resistor with a temperature coefficient opposing said temperature coefficient across the base-emitter junction of said first transistor.

2. The voltage reference circuit of claim 1 wherein said second means includes a second transistor having a collector, a base and an emitter, said base being coupled to said collector of said first transistor, said emitter being coupled to said base of said first transistor, said collector being coupled to a second source of operating potential.

3. The voltage reference circuit of claim 2 wherein said first means comprises:

third means for providing a reference signal at an output;

a third transistor having a collector, a base and an emitter, said base being responsive to said reference signal, said collector being coupled to said collector of said first transistor; and a second resistor coupled between said emitter of said third transistor and a said second source of operating potential.

4. The voltage reference circuit of claim 3 wherein said third means includes:

a fourth transistor having a collector, a base and an emitter, said base being coupled to said output of said first means;

a third resistor coupled between said emitter of said fourth transistor and said second source of operating potential;

a fifth transistor having a collector, a base and an emitter, said base being coupled to said base of said fourth transistor;

a fourth resistor coupled between said emitter of said fifth transistor and said second source of operating potential;

a sixth transistor having a collector, a base and an emitter, said emitter being coupled to said first source of operating potential;

a fifth resistor coupled between said collectors of said fifth and sixth transistors;

a seventh transistor having a collector, a base and an emitter, said base being coupled to said base of said sixth transistor;

a sixth resistor coupled between said collectors of said fourth and seventh transistors; and a seventh resistor coupled between said emitter of said seventh transistor and said first source of operating potential.

5. The voltage reference circuit of claim 4 wherein said third means further includes:

an eighth transistor having a collector, a base and an emitter, said base being coupled to said collector of said seventh transistor, said collector being coupled to said second source of operating potential, said emitter being coupled to said bases of said sixth and seventh transistors; and a ninth transistor having a collector, a base and an emitter, said base and collector being coupled together to said base of said sixth transistor, said emitter being coupled to said first source of operating potential.

6. The voltage reference circuit of claim 5 wherein said third means further includes:

a tenth transistor having a collector, a base and an emitter, said base and collector being coupled together to said bases of said fourth and fifth transistors;

an eighth resistor coupled between said emitter of said tenth transistor and said second source of operating potential;

an eleventh transistor having a collector, a base and an emitter, said collector being coupled to said collector of said tenth transistor, said base being coupled to said collector of said sixth transistor;

a twelfth transistor having a collector, a base and an emitter, said base and collector being coupled together to said emitter of said eleventh transistor;

a ninth resistor coupled between said emitter of said twelfth transistor and said first source of operating potential; and a capacitor coupled between said base of said eleventh transistor and said first source of operating potential.

7. The voltage reference circuit of claim 6 wherein said third means further includes:

a first diode having a cathode coupled to said first source of operating potential and having an anode;

a second diode having a cathode coupled to said anode of said first diode and having an anode;

a third diode having a cathode coupled to said anode of said second diode and having an anode;

a fourth diode having a cathode coupled to said anode of said third diode and having an anode;

a fifth diode having an anode coupled to said anode of said fourth diode and having a cathode coupled to said collector of said fifth transistor; and a ninth resistor coupled between said anode of said fourth diode and said second source of operating potential.

8. A method of developing an output voltage operating independent of temperature, comprising the steps of:

supplying a first current having a selectable temperature coefficient;

passing said first current through a first transistor and a first resistor, said first transistor having a temperature coefficient across the base-emitter junction thereof; and developing a potential across said first resistor having a temperature coefficient opposing said temperature coefficient across the base-emitter junction of said first transistor for substantially canceling temperature induced variation in the output voltage.

9. A circuit for providing a reference signal at an output, comprising:

a first transistor having a collector, a base and an emitter, said base being coupled to the output of the circuit;

a first resistor coupled between said emitter of said first transistor and a first source of operating potential;

a second transistor having a collector, a base and an emitter, said base being coupled to said base of said first transistor;

a second resistor coupled between said emitter of said second transistor and said first source of operating potential;

a third transistor having a collector, a base and an emitter, said emitter being coupled to a second source of operating potential;

a third resistor coupled between said collectors of said second and third transistors;

a fourth transistor having a collector, a base and an emitter, said base being coupled to said base of said third transistor;

a fourth resistor coupled between said collectors of said first and fourth transistors;

a fifth resistor coupled between said emitter of said fourth transistor and said second source of operating potential;

first means coupled between said collector of said fourth transistor and said bases of said third and fourth transistors for providing base drive thereto;

second means coupled between said collector of said third transistor and said bases of said first and second transistors for maintaining the potential developed at said bases of said first and second transistors independent of the potential applied at said first source of operating potential; and third means for starting the operating of the circuit.

10. The circuit of claim 9 wherein said first means includes:

a fifth transistor having a collector, a base and an emitter, said base being coupled to said collector of said fourth transistor, said collector being coupled to said first source of operating potential, said emitter being coupled to said bases of said third and fourth transistors; and a sixth transistor having a collector, a base and an emitter, said base and collector being coupled together to said base of said third transistor, said emitter being coupled to said second source of operating potential.

11. The circuit of claim 10 wherein said second means includes:

a seventh transistor having a collector, a base and an emitter, said base and collector being coupled together to said bases of said first and second transistors;

a sixth resistor coupled between said emitter of said seventh transistor and said first source of operating potential;

an eighth transistor having a collector, a base and an emitter, said base being coupled to said collector of said third transistor, said collector being coupled to said collector of said seventh transistor;

a ninth transistor having a collector, a base and an emitter, said base and collector being coupled together to said emitter of said eighth transistor;

a seventh resistor coupled between said emitter of said ninth transistor and said second source of operating potential; and a capacitor coupled between said base of said eighth transistor and said second source of operating potential.

12. The voltage reference circuit of claim 11 wherein said third means includes:

a first diode having a cathode coupled to said second source of operating potential and having an anode;

a second diode having a cathode coupled to said anode of said first diode and having an anode;

a third diode having a cathode coupled to said anode of said second diode and having an anode;

a fourth diode having a cathode coupled to said anode of said third diode and having an anode;

a fifth diode having an anode coupled to said anode of said fourth diode and having a cathode coupled to said collector of said second transistor; and an eighth resistor coupled between said anode of said fourth diode and said first source of operating potential.

13. A voltage reference circuit for providing a voltage at an output, comprising:

first means for providing a reference signal at an output;

a first transistor having a collector, a base and an emitter, said base being responsive to said reference signal, said emitter being coupled to a first source of operating potential, said collector supplying a current having a predetermined temperature coefficient;

a first resistor coupled between said emitter of said first transistor and said first source of operating potential;

a second transistor having a collector, a base and an emitter, said collector being coupled to said collector of said first transistor, said base being coupled to the output of the voltage reference circuit, said first transistor having a temperature coefficient across the base-emitter junction thereof;

second means coupled between said collector and base of said second transistor for supplying base drive thereto; and a second resistor coupled between said emitter of said second transistor and a second source of operating potential for conducting said current having a predetermined temperature coefficient which develops a potential across said second resistor with a temperature coefficient opposing said temperature coefficient across the base-emitter junction of said first transistor and substantially cancels the temperature induced variation in the voltage developed at the output of the voltage reference circuit.

14. The voltage reference circuit of claim 13 wherein said second means includes a third transistor having a collector, a base and an emitter, said base being coupled to said collector of said second transistor, said emitter being coupled to said base of said second transistor, said collector being coupled to said first source of operating potential.

15. The voltage reference circuit of claim 14 wherein said first means includes:

a fourth transistor having a collector, a base and an emitter, said base being coupled to said output of said first means;

a third resistor coupled between said emitter of said fourth transistor and said second source of operating potential;

a fifth transistor having a collector, a base and an emitter, said base being coupled to said base of said fourth transistor;

a fourth resistor coupled between said emitter of said fifth transistor and said second source of operating potential;

a sixth transistor having a collector, a base and an emitter, said emitter being coupled to said first source of operating potential;

a fifth resistor coupled between said collectors of said fifth and sixth transistors;

a seventh transistor having a collector, a base and an emitter, said base being coupled to said base of said sixth transistor;

a sixth resistor coupled between said collectors of said fourth and seventh transistors; and a seventh resistor coupled between said emitter of said seventh transistor and said first source of operating potential.

16. The voltage reference circuit of claim 15 wherein said first means further includes:

an eighth transistor having a collector, a base and an emitter, said base being coupled to said collector of said seventh transistor, said collector being coupled to said second source of operating potential, said emitter being coupled to said bases of said sixth and seventh transistors; and a ninth transistor having a collector, a base and an emitter, said base and collector being coupled together to said base of said sixth transistor, said emitter being coupled to said first source of operating potential.

17. The voltage reference circuit of claim 16 wherein said first means further includes:

a tenth transistor having a collector, a base and an emitter, said base and collector being coupled together to said bases of said fourth and fifth transistors;

an eighth resistor coupled between said emitter of said tenth transistor and said second source of operating potential;

an eleventh transistor having a collector, a base and an emitter, said collector being coupled to said collector of said tenth transistor, said base being coupled to said collector of said sixth transistor;

a twelfth transistor having a collector, a base and an emitter, said base and collector being coupled together to said emitter of said eleventh transistor;

a ninth resistor coupled between said emitter of said twelfth transistor and said first source of operating potential; and a capacitor coupled between said base of said eleventh transistor and said first source of operating potential.

* * * * *